United States Patent [19]

Ross

[11] 3,970,286

[45] July 20, 1976

[54] APPARATUS FOR USE IN STRINGING POWER LINES

[76] Inventor: Arthur W. Ross, 94 Brimbal Ave., Boston, Mass. 01915

[22] Filed: Apr. 18, 1975

[21] Appl. No.: 569,164

Related U.S. Application Data

[63] Continuation-in-part of Ser. No. 503,040, Sept. 3, 1974, Pat. No. 3,908,962.

[52] U.S. Cl. ..... 254/134.3 R

[51] Int. Cl.[2] ..... E21C 29/16

[58] Field of Search ..... 254/134.3 R, 134.3 PA, 254/192–197

[56] References Cited

UNITED STATES PATENTS

| | | | |
|---|---|---|---|
| 692,864 | 2/1902 | Lantz | 254/194 |
| 797,769 | 8/1905 | Hall | 254/195 |
| 798,652 | 9/1905 | Baughman | 254/193 |
| 2,983,037 | 5/1961 | Hendrix | 254/134.3 R |
| 3,596,878 | 8/1971 | Parsen | 254/134.3 R |

*Primary Examiner*—Al Lawrence Smith
*Assistant Examiner*—Robert C. Watson
*Attorney, Agent, or Firm*—Wolf, Greenfield & Sacks

[57] ABSTRACT

The apparatus is for use in a method for installing power lines which are to be hung between spaced poles. The power lines are supported by and installed with the assistance of spacers, typically referred to in the art as "lobsters" and which are hung by means of the pulley apparatus of this invention from the tensioned messenger wire. The pulley means may comprise one or more pulleys, a support bracket, and pivotal arms that facilitate easy attachment of a pulling line or tag line to the apparatus.

13 Claims, 6 Drawing Figures

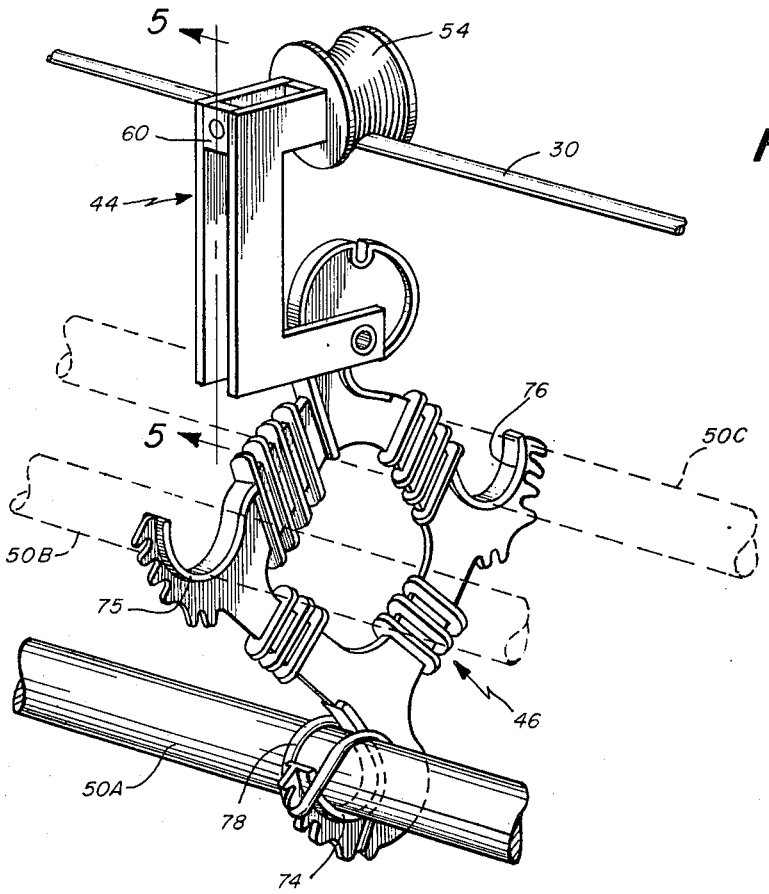
FIG. 4
FIG. 5
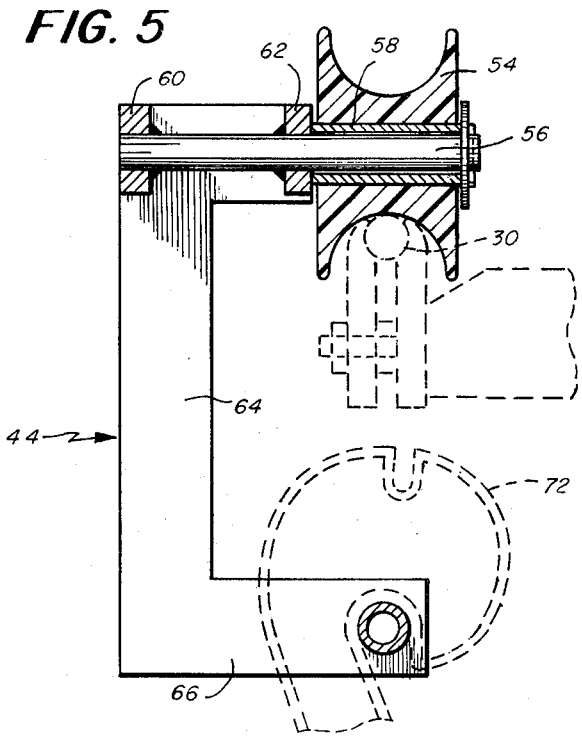
FIG. 6
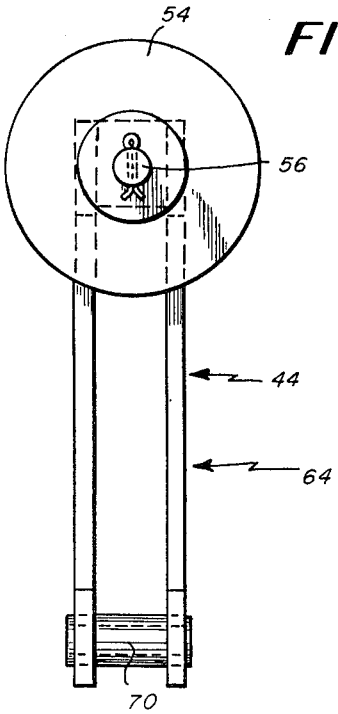

APPARATUS FOR USE IN STRINGING POWER LINES

RELATED APPLICATIONS

This is a continuation-in-part of application Ser. No. 503,040 filed Sept. 3, 1974, now U.S. Pat. No. 3,908,962 which is hereby incorporated by reference into the present application.

BACKGROUND OF THE INVENTION

The present invention pertains to an apparatus that is used in the stringing of power distribution lines. More particularly, the apparatus of this invention is adapted for use with the improved method disclosed in my application Ser. No. 503,040, which method facilitates easier and quicker installation of power lines or cables.

A typical prior art installation procedure requires the use of a plurality of rather bulky pulley clusters, each of which comprises a series of pulleys for accommodating each of the wires that are to be installed. Also, there are required tag lines that extend between each pulley cluster for positioning the pulley clusters the proper predetermined distance as they are pulled.

One of the disadvantages associated with this prior art installation procedure is that the pulley clusters are heavy, expensive and bulky and pose a hazzard to the public in that it is possible that they could fall from the messenger wire from which they are supported. Also, generally the wires that are extending through the pulley cluster may not be made alive until the pulley clusters have been completely removed and plastic spacers substituted in their place. Therefore, the prior art installation procedure requires an excessive number of steps before completion.

Accordingly, one of the objects of the present invention is to provide an improved apparatus for use in the stringing of power lines that is not bulky, heavy and expensive as the heretofore mentioned pulley clusters are.

Another object of the present invention is to provide an apparatus in accordance with the preceeding object and which is relatively simple in construction and can be at least partially folded to a more compact position for ease in handling and carrying.

Still a further object of the present invention is to provide an improved apparatus for use in the stringing of power lines and which is stable in its operation as it is pulled along a support wire.

SUMMARY OF THE INVENTION

To accomplish the foregoing and other objects of this invention, there is disclosed an apparatus for use in a method of installing a power distribution line. The power distribution line or system that is to be installed may be of the type that has a plurality of individual wires including a support wire installed between existing poles. These wires are finally supported from the supporting wire by means of an insulating spacer, typically referred to in the art as a "lobster". In accordance with the method of operation, there is provided a support member that may be in the form of a fixed pulley cluster and which is installed at a fixed position at the beginning of a run. A plurality of side-by-side wires are passed through the support member and are pulled, in unison. A plurality of pulley means constructed in accordance with the principles of this invention are provided and are hung from the supporting wire with each including means for receiving the spacer. One spacer is hung from each pulley apparatus and this combination is secured each at predetermined distances along the wires as the wires are pulled. The pulley means may be of the single pulley or the double pulley type and in a preferred embodiment comprises a folding arm arrangement which permits easy securing of a pole line or tag line to the pulley apparatus.

BRIEF DESCRIPTION OF THE DRAWINGS

Numerous other objects, features and advantages of the invention will now become apparent upon a reading of the following detailed description taken in conjunction with the accompanying drawings, in which:

FIG. 4 shows a perspective view of an alternate embodiment for the pulley means of this invention supported from a messenger wire;

FIG. 5 is a cross-sectional view taken along line 4—4 of FIG. 4; and

FIG. 6 is a side view of the pulley means shown in FIG. 5.

DETAILED DESCRIPTION

In my continuation-in-part application Ser. No. 503,040, there is disclosed a method wherein a plurality of pulley means are employed, each for supporting a spacer which is typically referred to in the art as a "lobster". In accordance with this method the wires are secured in the spacer and when the wires are pulled, the spacer which is supported also by the pulley means is pulled along a messenger wire until the proper predetermined position for the spacer is reached. When a string of these spacers and pulley means have been properly positioned along the wires then the pulley means can be removed and the spacer is hung from the messenger wire.

Figure 1:
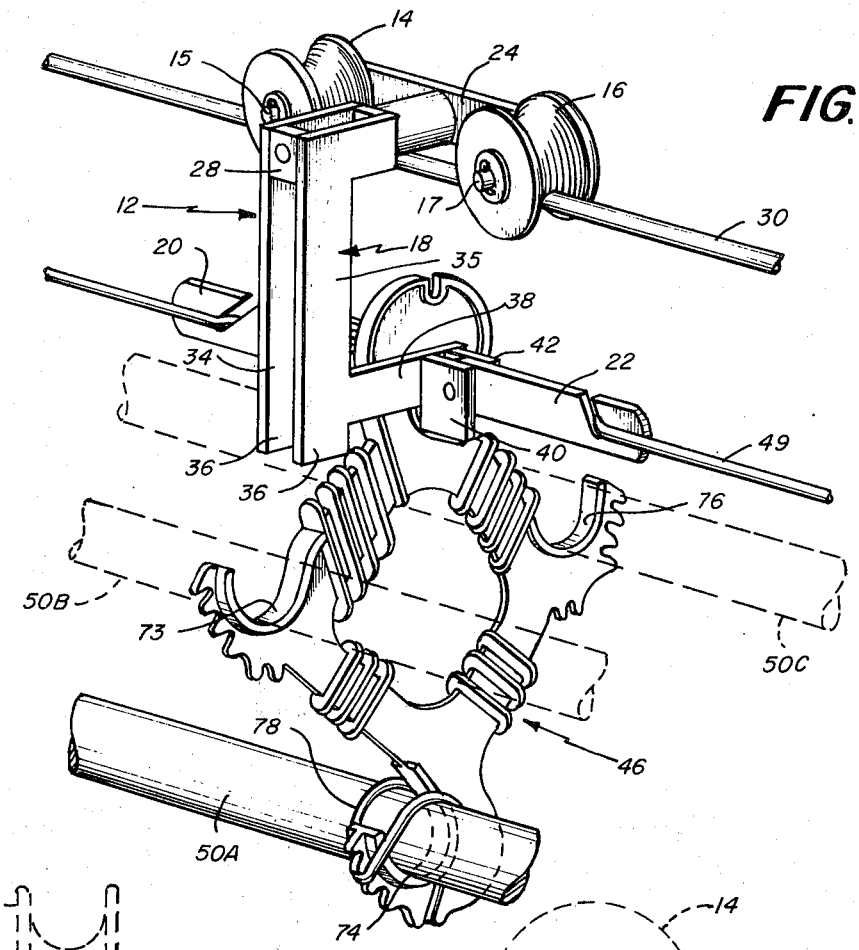
FIG. 1 shows a perspective view of the spacer and one embodiment for a pulley means constructed in accordance with the principles of the present invention.

FIG. 1 shows a perspective view of a preferred embodiment on the pulley means or pulley apparatus 12. This apparatus 12 is supported from a messenger wire 30 which is held securely in place between existing poles. FIG. 1 shows only a segment of this messenger wire. A typical spacer 46, which is referred to as a "lobster", is supported from the pulley apparatus 12. The pulley apparatus 12 generally comprises pulleys 14 and 16, support bracket 18, and arms 20 and 22. The pulleys 14 and 16 are supported respectively by shafts 15 and 17 from revolvable bar 24. Bar 24 is pivotal about fixed shaft 26. Shaft 26 is supported in a fixed manner by means of members 28 and 30. A collar 32 is also provided intermediate member 30 and bar 24. A conventional fastening arrangement may be used for securing the bar 24 to the shaft 26 such as the washer and cotter pin shown in FIG. 3.

The support member 18 comprises a pair of like C-shaped members 34 and 35. These members are secured at their top ends to the members 28 and 30 such as by spot welding. Each of the members 34 and 35 terminate in bottom legs 36 and have horizontal portions 38 extending near the base therefrom. A shaft 39 extends between the ends of the members 38 and is for supporting the spacer 46.

From opposite sides of the horizontal members 38, there extend square walls 40 and 42 which may be suitably welded to the portion 38. These walls 40 and 42 define a space therebetween having a shaft 44 extending thereacross. This shaft 44 passes through an aperture in the arm 20 or 22 and thus the arms are pivotal relative to the walls 40 and 42.

Figure 3:
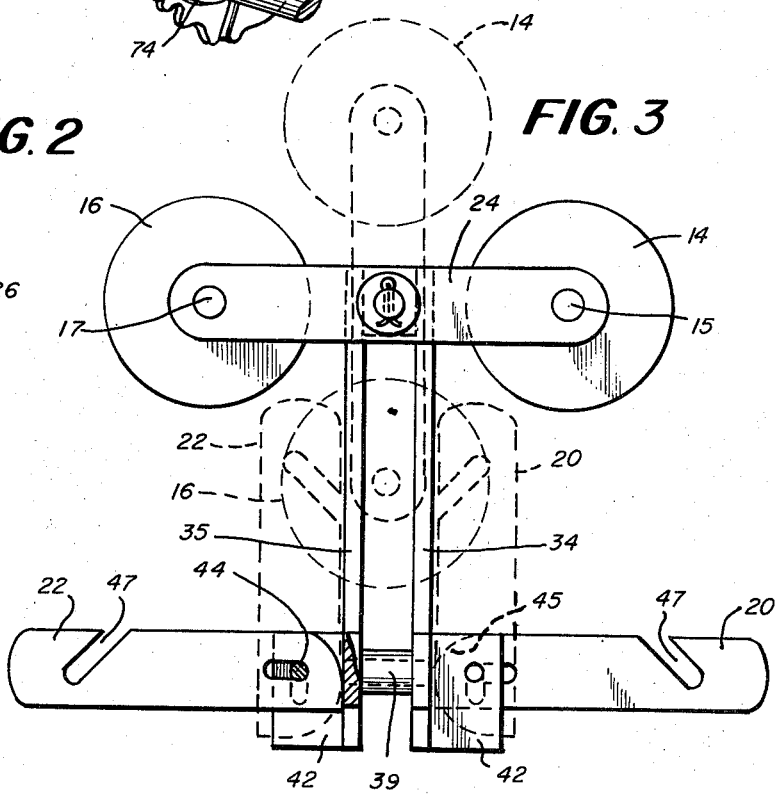
FIG. 3 is a side view of the pulley means shown in FIG. 1.

FIG. 3 shows in solid the arms 20 and 22 pivoted downwardly to their horizontal position. FIG. 3 also shows the arms 20 and 22 in phantom in their vertical or folded up position when they are not in use. Both of these arms have an arcuate portion 45 that permits pivoting of the arms and the slots in the arms for accommodating the shaft 44 are elongated as shown in FIG. 3 so that when the arms are moved to their vertical position, they can fall down slightly and are interlocked in that position. The arms must then be lifted slightly in order to permit pivoting to the horizontal position. Furthermore, the arms 20 and 22 are provided with diagonal slots 47 for accommodating the tag line or rope line 49 which is shown in FIG. 1 as being continuous and looping through the slots 47 in the arms 20 and 22.

FIG. 1 shows the pulley apparatus in its usable position with the pulleys 14 and 16 supported on the messenger wire 30. As previously mentioned, the tag line 49 is interwoven between the arms 20 and 22 and the wires 50A, 50B and 50C are supported in the recesses 74, 73 and 76, respectively of the spacer 46. In FIG. 1, there is shown one loop 78 for securing one of the wires into the spacer.

Figure 2:
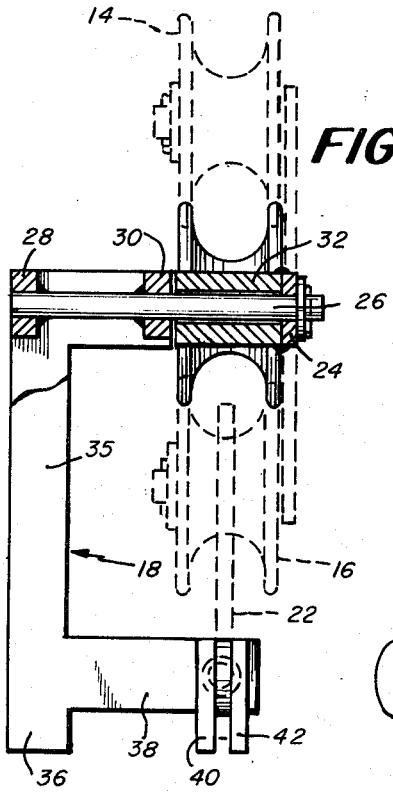
FIG. 2 is a cross-sectional view taken along line 2—2 of FIG. 1.

When the device is not in use, it is constructed so that it can be formed into a relatively compact unit. FIGS. 2 and 3 show the device in solid in the position shown in FIG. 1. However, FIGS. 2 and 3 also show the device folded, in phantom, to the more compact position. In this position, it is noted that the bar 24 is vertical as are the arms 20 and 22. Also, in this position, the legs 36 and the walls 40 and 42 form leg supports so that the apparatus stands quite easily.

FIG. 4 is a perspective view of an alternate embodiment for the pulley apparatus and this embodiment is somewhat more simplified than the one shown in FIGS. 1–3. In FIG. 4, the spacer 46 is supported by the pulley member 44. The pulley member 44 includes a pulley 54 (see also FIGS. 5 and 6) which engages with the messenger wire 30. The pulley 54 is supported by a shaft 56 and a bushing 58. The end of the shaft 56 is supported in a fixed manner from members 60 and 62. The pulley member 44 is of generally C-shape and includes a vertical portion 64 and a lower portion 66. The portions 64 and 66 are defined by parallel plates which are joined by post 70, shown in FIG. 6. The top hook shaped end 72 of the spacer 46 engages with the post 70 and the spacer is thereby supported from the pulley member 44.

As indicated in FIG. 4, the spacer 46 is of a general diamond shape and has a bottom recess 74 for accommodating wire 50A. The other two wires 50B and 50C are supported in recesses 75 and 76, respectively. FIG. 4 shows the wire 50A as being maintained in place by means of a securing loop 78. Similar securing loops could also be used for the other wires 50B and 50C. When the securing loop is in place and the wires are commonly pulled together then the pulley member 44 is moved along the messenger wire 30.

When all of the spacers and their associated pulley members are in the proper predetermined place and spaced the proper distance then it is quite easy to remove the pulley member and simply hang the spacer from the messenger wire. The hook shaped end 72 of the spacer engages with the messenger wire 30.

What is claimed is:

1. An apparatus for installing a power distribution line having a plurality of individual wires including a supporting wire being installed between existing poles and wherein said wires are finally supported from said supporting wire by means of an insulating spacer, said apparatus comprising a pulley, means for supporting said pulley including a shaft extending through said pulley, a C-shaped support member having a top end for receiving said shaft and thereby supporting the pulley at the top end thereof, said C-shaped support member having opposing parallel walls defining a lower leg at the lower end of the support member and a post extending between said walls of said lower leg and for supporting said spacer.

2. The apparatus of claim 1 wherein said shaft and post extend in substantially orthogonal directions.

3. The apparatus of claim 2 including a pair of shaft support members each extending between opposing walls in the top end of the support member, said C-shaped member having its two legs extending in the same direction with the pulley supported from the top leg and the post supported by the bottom leg, the pulley and post being in vertical alignment with the main part of the support member connecting the legs out of alignment with the pulley and post.

4. An apparatus for installing a power distribution line having a plurality of individual wires including a supporting wire being installed between existing poles and wherein said wires are finally supported from said supporting wire by means of an insulating spacer having a hooked top, said apparatus comprising a pulley, a support member having a C-shape supporting the pulley at one end and having opposing walls at the other end thereof and a post extending between the walls and for receiving the hooked top of said spacer, said member having an intermediate section out of line with the pulley and post.

5. The apparatus of claim 4 including a shaft and bushing for supporting said pulley.

6. A mobile apparatus for support from a wire or cable and for supporting a spacer, said apparatus comprising;

at least one pulley, a support bracket, means for supporting said pulley at one end of said support bracket, said support bracket having means at the other end for supporting said spacer, a pair of pivotal arms, and means for mounting the arms extending in opposite directions at the other end of the support bracket.

7. A mobile apparatus as set forth in claim 6 comprising a pair of pulleys and wherein said supporting means for the pulleys comprises a bar having a pulley supported at either end and a shaft extending between the one end of the support bracket and the bar, said bar being easily rotatable relative to the support bracket.

8. A mobile apparatus as set forth in claim 7 further comprising blocks secured to the bracket for supporting the shaft in a fixed position.

9. A mobile apparatus as set forth in claim 6 wherein said support bracket is C-shaped and has at least three legs for permitting the apparatus to stand upright.

10. A mobile apparatus as set forth in claim 6 wherein the support bracket has two opposing walls and said spacer support means comprises a post extending between the walls.

11. A mobile apparatus as set forth in claim 10 wherein said mounting means for the arms includes a pair of mounting walls for each arm, said arm having a slot for receiving a pin to support the arm between the wall pair.

12. A mobile apparatus as set forth in claim 11 wherein said slot in the arm is elongate and each arm also has a notch remote from the slot for receiving a pull line.

13. A mobile apparatus as set forth in claim 6 wherein the arms have slots at their ends.

* * * * *

UNITED STATES PATENT OFFICE

CERTIFICATE OF CORRECTION

Patent No. 3,970,286 Dated July 20, 1976

Inventor(s) Arthur W. Ross

It is certified that error appears in the above-identified patent and that said Letters Patent are hereby corrected as shown below:

Please change the Post Office address on issued patent 3,970,286 to read 94 Brimbal Avenue, Beverly, Massachusetts 01915.

Signed and Sealed this

Eighth Day of February 1977

[SEAL]

*Attest:*

RUTH C. MASON
*Attesting Officer*

C. MARSHALL DANN
*Commissioner of Patents and Trademarks*